United States Patent [19]

Jones

[11] 4,257,880

[45] Mar. 24, 1981

[54] CENTRIFUGAL AIR CLASSIFYING APPARATUS

[76] Inventor: Donald W. Jones, P.O. Box 1329, Sylacauga, Ala. 35150

[21] Appl. No.: 53,063

[22] Filed: Jun. 28, 1979

[51] Int. Cl.[3] ..... B07B 7/083

[52] U.S. Cl. ..... 209/144; 209/139 R

[58] Field of Search ..... 209/139 R, 139 A, 144, 209/145

[56] References Cited

U.S. PATENT DOCUMENTS

| | | | |
|---|---|---|---|
| 1,146,633 | 7/1915 | Lyons | 209/139 A |
| 3,384,238 | 5/1968 | Alpha | 209/144 X |

FOREIGN PATENT DOCUMENTS

| | | | |
|---|---|---|---|
| 817239 | 10/1951 | Fed. Rep. of Germany | 209/144 |

*Primary Examiner*—Ralph J. Hill

*Attorney, Agent, or Firm*—Mason, Fenwick & Lawrence

[57] ABSTRACT

A centrifugal air classifying apparatus for use with a cyclone type centrifugal separator and a fan for drawing air from the separator and returning it at superatmospheric pressure to the classifying apparatus, wherein the classifying apparatus has a rotary particle rejector in its upper portion for classifying material fed into a rising and rotating column of air outwardly surrounding the rejector. A first primary annular sealing zone is provided adjacent the tops of the rejector blades and a secondary annular sealing ring is provided at an intermediate location between the upper and lower ends of the blades.

4 Claims, 5 Drawing Figures

CENTRIFUGAL AIR CLASSIFYING APPARATUS

BACKGROUND AND OBJECTS OF THE INVENTION

The present invention relates to classifying systems for separating and classifying particles according to their size to produce separate discharges of fine product below a certain particle size and coarser product, and more particularly to product classifying systems of the centrifugal air type having means for achieving air suspension of the particles to be classified and vertical blade rotary rejector means for achieving separation and recovery of various small size material.

Heretofore, various centrifugal type air classifying devices have been provided to achieve separation of very small material, for example of the order of 10 to 12 micron material from particle material being supplied to the classifier, such as disclosed in earlier U.S. Pat. Nos. 3,384,238 and 3,615,009. While these prior art classifying machines are capable of recovering a small percentage of a 10–12 micron material from a mix of particle material being supplied to the classifier, it has been difficult to achieve the desired precision of the size limit or sharpness of cut in the very small size, ultra-fine size of cut, for example in the region of about a 5 micron topsize cut, and it has been very difficult to obtain a satisfactory percentage of fine recoverability when attempting to attain air classification of fine particles in the size range below 10 microns. My experience indicates that the recoverability of the position of fine particles in the 10 micron and below range by air classification compared to the percentage available is very low and attainment of reliable separation or topsize cuts in the range of about 5 microns has not been satisfactorily realized, mainly because of poor seal design.

The present invention relates to a centrifugal type air classifying system capable of achieving separation or classification at very small sizes, for example capable of separating fines with a 5 micron topsize cut and with considerably improved recoverability in the percentage of fine particles compared to the percentage available, by providing a main classifying chamber with a vertical blade rotary rejector, associated with a lower classifying or expansion chamber for return air, and a fine particle collector cyclone, incorporated in an air duct and fan loop including a fan to supply transport and particle suspension air for the classifying of the fines. The cut point or upper limit of particle size classified by the system is variable by increasing or decreasing the speed of the vertical blade rotary rejector. The material to be classified is delivered to the main or upper classifying chamber so that the material "floats or swims" to the classifying chamber in a fluffy or dispersed state, and a tapered blade configuration is provided for the vertical blade rotary rejector associated with a novel primary main seal and secondary safety seal between the positive pressure and negative pressure zones of the vertical blade rotary rejector. The blade configuration provides varying tip speed which is highest at the top of the vertical blade rotary rejector, causing more air to flow at the top of the main classifying chamber giving better dispersion, and allowing the bottom portion of the vertical blade rotary rejector to recover a higher percentage of the fine material entering the classifying chamber.

An object of the present invention is the provision of a novel centrifugal air type classifying system for effectively classifying materials of very small size, in the order of about a 5 micron topsize cut, which achieves improved percentage of fine particle recovery compared to the percentage of fines available through improved seal design and through the novel design of the vertical blade rotary rejector, and wherein the upper limit or cut point of the fine material to be separated may be varied by varying the speed of the vertical blade rotary rejector.

Other objects, advantages and capabilities of the present invention will become apparent from the following detailed description, taken in conjunction with the accompanying drawings illustrating a preferred embodiment of the invention.

Figure 1:
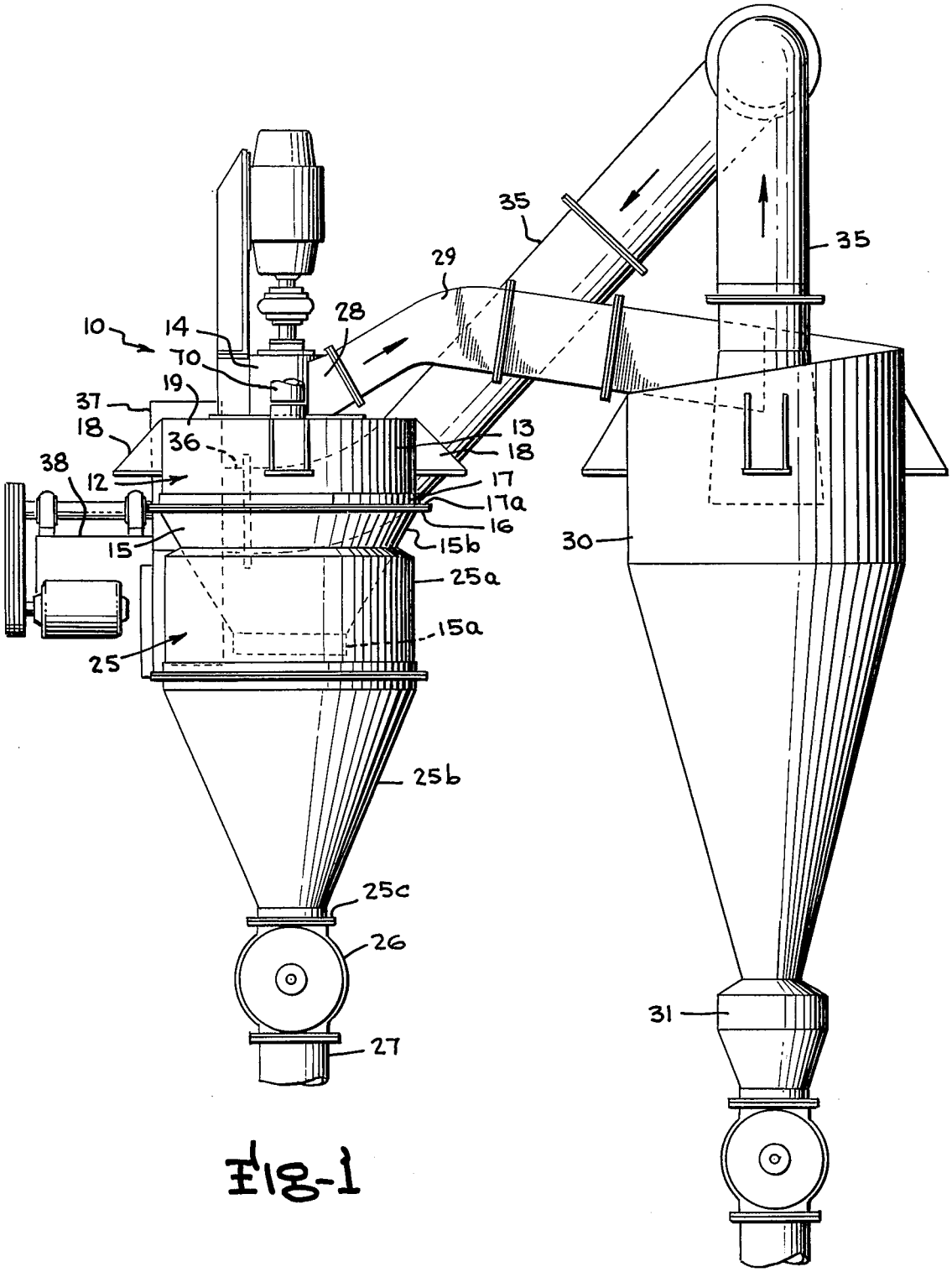
FIG. 1 is a side elevation view of a centrifugal type air classifying system for separating very fine particles from a mixed particle size feed, embodying the present invention.
Figure 2:
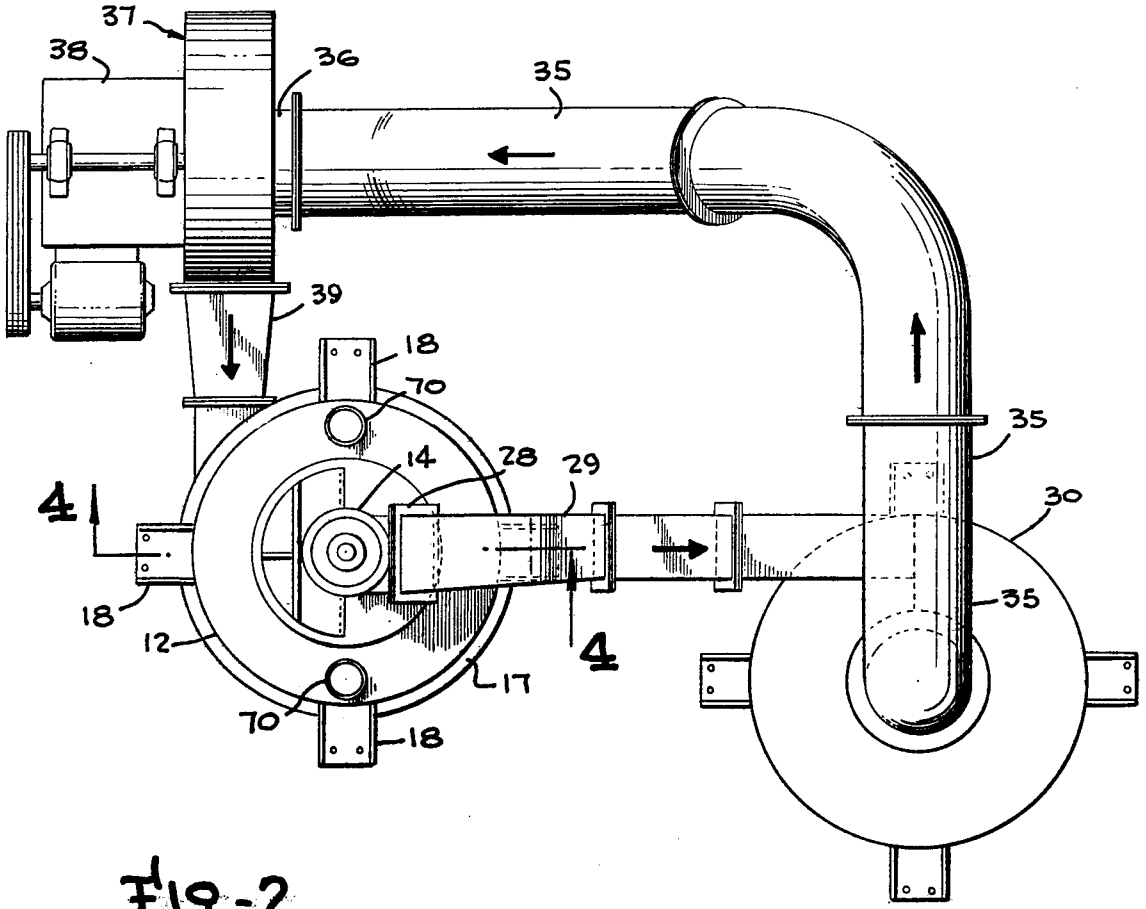
FIG. 2 is a top plan view of the system illustrated in FIG. 1.
Figure 3:
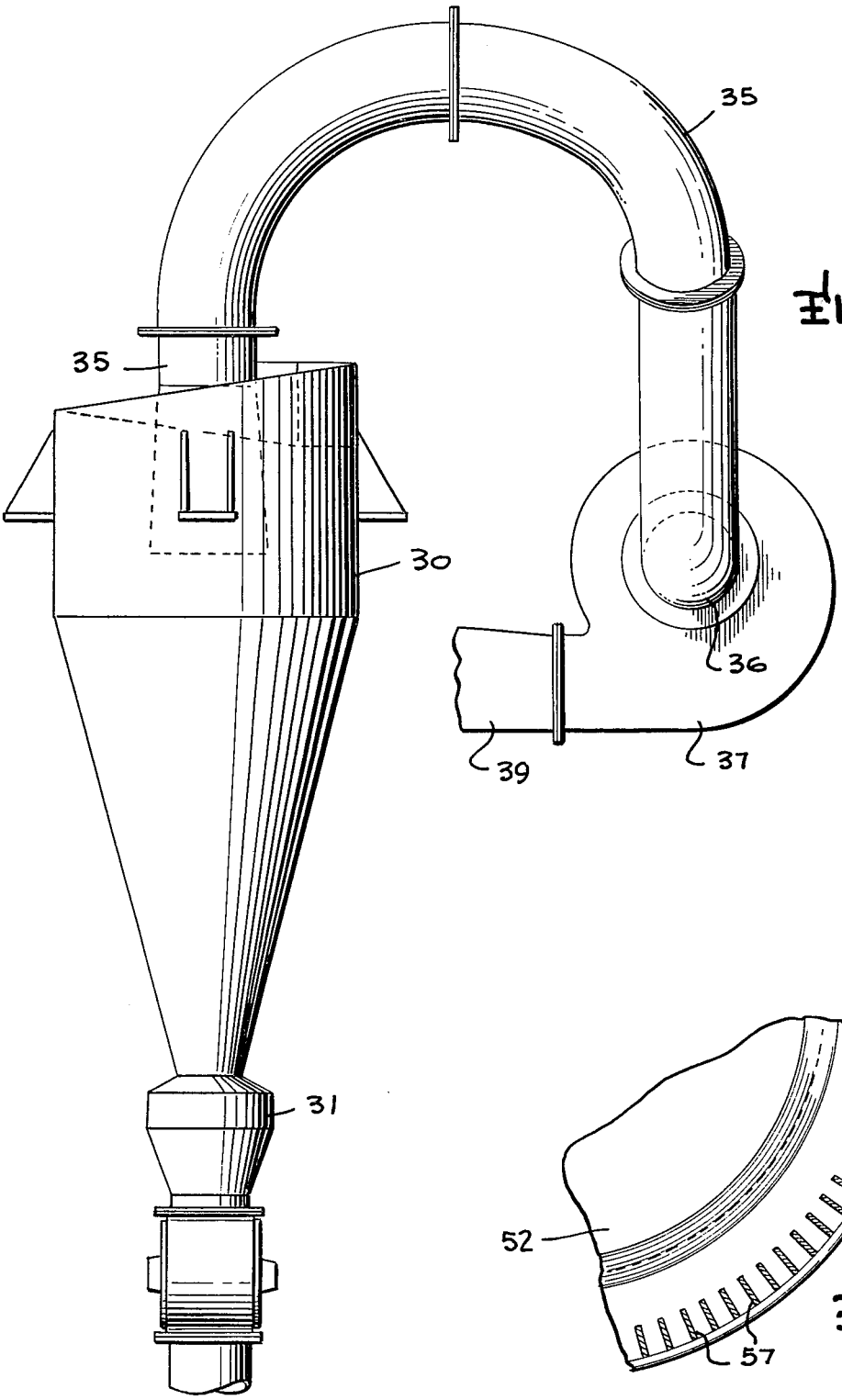
FIG. 3 is an elevation view of the system of FIG. 1, viewed from the right of FIG. 1.
Figure 5:
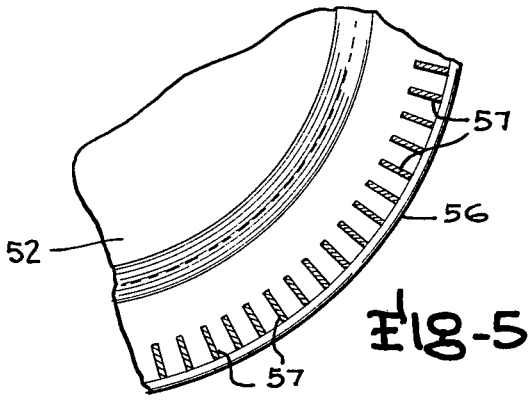
FIG. 5 is a fragmentary section view taken along the line 5—5 of FIG. 4.

Referring to the drawings, wherein like reference characters designate corresponding parts throughout the several figures, and referring particularly to FIGS. 1–3, the centrifugal type air classifying system of the present invention, indicated generally by the reference character 10, comprises an upper main classifying or rejector chamber and rotor assembly, indicated generally by the reference character 12, formed of a generally cylindrical rejector chamber portion 13 and an upwardly projecting cylindrical rotor support housing portion 14, assembled with a downwardly converging conical expansion chamber classifier, for example having a maximum diameter of about 44 inches, indicated generally at the reference character 15. The rejector chamber section 13 and classifier 15 are assembled, for example, by the horizontal flanges 16,17*a* formed at the upper lip of the conical expansion chamber classifier 15 and the bottom of the annular angle iron mounting collar 17 at the bottom of the rejector chamber 13 and these assembled sections may be supported on suitable frame members by mounts such as the angle beam members 18. The rejector chamber 13 has a cylindrical outer or side wall 19 concentric with the vertical center axis of the rejector chamber and rotor assembly 12 and assembled to the mounting angle iron collar 17, and has a generally circular top wall 20 provided with a large center opening 21 on which is surmounted the support housing 14 of generally cylindrical configuration having an annular outwardly projecting intermediate mounting collar 22 fixed to the top support housing wall 20 by cap screws or similar fastenings indicated at 23.

The downwardly converging conical expansion chamber classifier 15 forms the lower unit of the main classifier 12 and provides an expansion chamber for the coarse particles which have been rejected from the upper rejector section 13 to be collected. The size of the opening, indicated at 15*a*, at the bottom of the cone portion 15*b* of the expansion chamber classifier section 15 is a variable which would be based on the bulk density of whatever material is to be fed to the classifier. The lower portion of the expansion chamber classifier cone 15 extends into the upper region of the cylindrical portion 25*a* of a receiver cone 25 having a lower cone shaped portion 25*b*, and the bottom opening 25*c* of this receiver cone 25 is connected to a conventional air lock 26 whose lower end connects to a coarse product discharge conduit 27 to lead the coarse product to the desired collection station.

The support housing 14 of the rotor assembly includes an upwardly inclined outlet formation 28 which connects by a duct 29 for example a 12" diameter duct, to the upper portion of a fine particle classifier cyclone collector 30 disposed laterally from and alongside the assembly of the main classifying or rejector chamber and rotary assembly 12, expansion chamber cone classifier section 15 and cone receiver 25. The fines or light material, which have passed through the rotor assembly 14, later described in detail, are transported through the duct 29 to the fine particle classifier cyclone 30, which is specially designed to provide a screw top shaped so as to force the airstream carrying the light or fine particles to the cyclone collector 30 in a downwardly spiraling direction. The pressure drop and decreasing velocity at the upper portion of the cyclone collector 30 allows the fines or light particles to fall out as the air is pushed downward. The spinning air in the cyclone collector 30 causes the fines or light particles to be held to the outside portion of the cyclone collector, so that as the fines or light particles are pushed down to the point of discharge of the cyclone collector, they are dropped out as they enter the small cyclone or expansion chamber portion 31 of the cyclone collector 30 at the bottom. A vortex of cleaner air moves upwardly through the cyclone collector back to the return duct 35 at the upper center of the cyclone collector and returns this air from the cyclone collector to the inlet 36 of the main system fan 37 driven by a suitable fan motor 38, from whence the air is close-circuited back through the fan discharge duct 39 to the cone section 15 of the rejector and rotary assembly 12.

Figure 4:
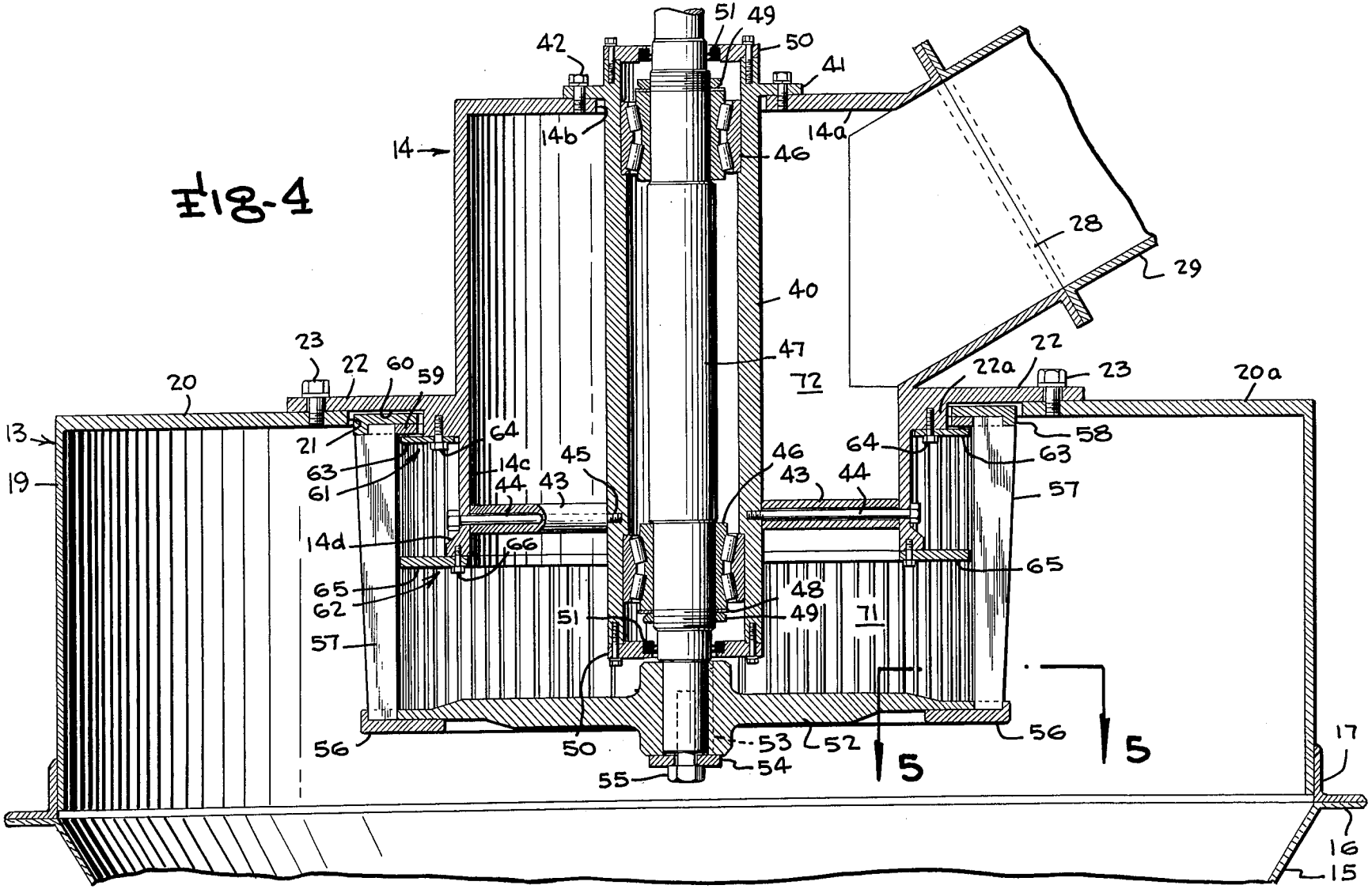
FIG. 4 is a vertical section view, to enlarged scale, through the rotor assembly upper portion of the main classifying chamber of the classifying system, taken along the line 4—4 of FIG. 2.

Referring now more particularly to FIG. 4 illustrating the details of the upper portion of the rejector chamber and rotor assembly 12 in larger scale, it will be seen that the support housing portion 14 is removably supported on the generally cylindrical housing 20 for the rejector chamber 13 by the annular collar or flange 22 lapping over the edges of the top wall portion 20*a* of the primary classifying chamber housing 20 and secured thereto by the cap screws 23 and that the support housing 14 in turn supports the generally vertically extending tubular cylindrical bearing housing 40. The support for the bearing housing 40 is provided by the upper annular collar or flange formation 41 lapping the top wall portion 14*a* of the rotor assembly support housing 14 bounding the opening 14*b* therein and fastened thereto by cap screws 42, and by a supporting spider formed of stabilizer tubes 43 and long cap screws 44 extending therethrough into tapped openings 45 in lower portions of the tubular bearing housing 40 and through the annular cylindrical lower wall portion 14*c* of the support housing 14 depending below the mounting flange or collar 22. The tubular bearing housing 40 has a pair of upper and lower bearing assemblies 46 journaling the vertical rejector shaft 47 concentrically therein, with a locking washer 48 and spanner nut 49 associated with each of the bearings 46. At the upper and lower ends of the tubular bearing housing 40 are a seal retainer cap, in the form of an annular plate, indicated at 50 secured to the annular end surfaces of the tubular bearing housing 40 by suitable cap screws and supporting an annular oil seal 51 bearing against the surface of the shaft 47.

Fixed to the lower end portion of the shaft 47 depending below the lower seal retainer cap 50 is a bottom spacer and hub member 52 which is fixed to the shaft 47 to be driven therewith by key 53 extending into aligned grooves or kerfs in the confronting portions of the shaft and the hub portion of the bottom spacer and hub member 52 and secured to the shaft by annular washer 54 and cap screw 55. The outer perimeter or edge of the spacer and hub member 52 has a bottom blade retainer 56 thereon, for securing the lower end portion of the vertically extending truncated wedge shaped rotor blades 57 in a generally cylindrical path outwardly of the depending annular cylindrical lower portion 14*c* of the support housing 14 and concentric with the axis of the shaft 47. The upper ends of the vertical rotor blades 57 are secured in position by an annular top blade retainer 58 and top spacer ring 59, which extends into and rotates within a downwardly opening annular cylindrical well 60 formed between the edge of the circular opening 21 in the top wall 14*a* of the housing 14 and the thickened root or inner portion of the annular mounting flange or collar 22 of the support housing 14.

The rejector chamber and rotor assembly includes a novel dual positive seal arrangement formed of a primary main positive seal indicated at 61 and a secondary safety seal arrangement indicated generally at 62. The primary main positive seal 61 is formed by the top blade retainer 58 projecting into the downwardly opening annular well 60 and by the positive seal ring 63 fixed to the thickened root or inner portion 22*a* of the support housing mounting collar 22 by cap screws 64 and lapping beneath the inner edge portion of the top blade retainer 58 and the top spacer ring 59 as shown, extending almost to the inner edges of the array of tapered blades 57. The secondary seal is formed by the annular secondary seal ring 65 fixed by cap screws 66 to the thickened lower end portion or rim 14*d* of the depending annular cylindrical lower portion 14*c* of the support housing 14 and extending to a location very close to the inner edges of the tapered rotor blades 57 with the outer edge of the secondary seal ring 65 lying in a circular path concentric with the axis of the rotor shaft 47 and of substantially the same diameter as the circular path of the outer edge of primary main positive seal ring 61.

The tapered blades 57 for the vertical blade rotary rejector are approximately ½" wider at the top than at the bottom, causing the vertical blade rotary rejector to have varying tip speed with a fixed shaft speed or center line speed. This varying tip speed, being the highest at the top of the vertical blade rotary rejector, causes more air to flow at the top of the rejector chamber 13, providing for better dispersion and allowing the bottom portion of the vertical blade rotary rejector to recover a high percentage of the fine material entering the classifying device.

The material to be classified is delivered or supplied to the upper or primary classifying chamber 13 by a slide type air conveyor through, for example, a pair of diametrically opposite classifier feed tubes indicated generally at 70. This type of feed system causes the material to "float or swim" to the upper main or primary classifying chamber 13 so that the material is in a very fluffy or dispersed state prior to entering the rejector chamber 13. The rotating vertical tapered blade rotor assembly of tapered blades 57 causing greater air flow at the top of the main classifying chamber than at the bottom, causes the material to be classified to be held in suspension around the rotor by an upward column of air supplied from the closed system fan 37, for example, a 50 h.p. fan. The centrifugal spin of the upward column of air causes the coarser particles to be on the outside of the spin and the finer particles to be toward the center. Increasing the speed of the vertical blade rotary rejector permits increase of the resistance of the upcoming air or decrease in the velocity of the air moving across the rotary blade rejector, which causes the material taken through the rejector to be finer because the transport velocity is being decreased. When the rejector speed is decreased, the transport velocity is increased across the rejector, allowing it to take coarser or heavier products inwardly toward the center. The size of the products taken inwardly toward the center through the rotor rejector blades pass upwardly through the zone 71 outwardly surrounding the bearing housing 40 and inwardly of the depending annular cylindrical lower supporting housing portion **14*c* into the upper zone 72 and outwardly through the outlet fitting 28, to pass through the duct 29 to the spirally formed upper portion of the fine particle cyclone collector 30. In the cyclone collector 30, the pressure drop and decreasing velocity allows the fine or light particles to fall out as the air is pushed downward to the point of discharge where the fines drop out into the small cyclone or expansion chamber 31 at the bottom and thence through the outlet conduit connected to the bottom of the cyclone collector 30**.

The assembly hereinabove described is completely sealed to atmosphere having no leakage and requiring no dust collection equipment such as is required with classifying devices heretofore marketed.

I claim:

1. A centrifugal air classifying apparatus for use with a cyclone type centrifugal separator and a fan for drawing air from the cyclone separator and returning the same at superatmospheric pressure to the centrifugal classifying apparatus, comprising a main classifying rejector chamber having a rotary particle rejector in its upper portion supported for rotation about a vertical axis, means forming an expansion chamber below and communicating with the rejector chamber, means for supplying superatmospheric air from the fan to the expansion chamber to develop a rising and rotating column of air in the expansion chamber and in the rejector chamber outwardly surrounding the rotary particle rejector, the material to be classified being introduced directly into the air column in the zone of the rejector chamber outwardly surrounding the rotary particle rejector by feed conduit means, the rotary particle rejector being generally in the configuration of a cylindrical fan having a large number of vertically aligned blades about its circumference whereby air from the rising and rotating column of air in the rejector chamber outwardly surrounding the rejector flows through the spaces between the blades to a discharge chamber located inside the rejector carrying with it particles of material being thrown off the blades, means communicating with the discharge chamber for transfer of the separated fine particles from the discharge chamber to the cyclone collector, a first primary annular sealing ring inwardly adjacent the tops of the blades at the top of the rejector chamber providing a primary seal zone, and a secondary annular sealing ring extending from a boundary portion of said discharge chamber to a location closely adjacent the inner edges of the rejector blades at an intermediate location between the upper and lower ends of the blades providing a secondary seal zone.

2. A centrifugal air classifying apparatus as defined in claim 1, wherein said first primary annular sealing ring is fixed to a stationary support housing portion located inwardly adjacent the top of the rotary particle rejector immediately below the upper ends of the rejector blades and extends to a location immediately inwardly of the inner edges of said blades.

3. A centrifugal air classifying apparatus as defined in claim 1, wherein the support housing for the rotary particle rejector includes wall portions defining the top and side of said rejector chamber and portions extending from the top wall portions downwardly in a tubular cylindrical path concentric with the axis of rotation of the rejector defining a cylindrical entrance throat to said discharge chamber lying inwardly of the path of the rejector blades, and said secondary sealing ring being fixed to the lower end of the tubular cylindrical depending section forming said entrance throat.

4. A centrifugal air classifying apparatus as defined in claim 2, wherein the support housing for the rotary particle rejector includes wall portions defining the top and side of said rejector chamber and portions extending from the top wall portions downwardly in a tubular cylindrical path concentric with the axis of rotation of the rejector defining a cylindrical entrance throat to said discharge chamber lying inwardly of the path of the rejector blades, and said secondary sealing ring being fixed to the lower end of the tubular cylindrical depending section forming said entrance throat.

* * * * *